US005147053A

United States Patent [19]

Friedenthal

[11] Patent Number: 5,147,053

[45] Date of Patent: Sep. 15, 1992

[54] CONTAINER WITH CHILD PROOF CLOSURE

[75] Inventor: Reginald Friedenthal, Johannesburg, South Africa

[73] Assignee: Daredi Products Close Corporation, Johannesburg, South Africa

[21] Appl. No.: 767,660

[22] Filed: Sep. 30, 1991

[51] Int. Cl.[5] ..... B65D 55/02

[52] U.S. Cl. ..... 215/216; 215/201; 215/211; 215/220; 215/221; 215/254

[58] Field of Search ..... 215/201, 203, 206, 208, 215/211, 216, 220, 254, 255, 301, 330, 332, 334, 336, 337

[56] References Cited

U.S. PATENT DOCUMENTS

| | | | |
|---|---|---|---|
| 2,964,207 | 12/1960 | Towns | 215/220 |
| 3,445,022 | 5/1969 | Cilluffo | 215/216 |
| 3,595,417 | 7/1971 | Musher | 215/208 X |
| 3,794,200 | 2/1974 | Marks | 215/201 |
| 3,820,676 | 6/1974 | Mucsi | 215/220 |
| 3,884,379 | 5/1975 | Landen | 215/221 |
| 4,007,850 | 2/1977 | Beaugrand | 215/216 |
| 4,011,829 | 3/1977 | Wachsmann et al. | 215/201 X |
| 4,144,983 | 3/1979 | Pauls et al. | 215/216 |
| 4,149,646 | 4/1979 | Julian | 215/216 |
| 4,159,779 | 7/1979 | Hedgewick | 215/214 |
| 4,353,473 | 10/1982 | Morris | 215/220 |
| 4,427,124 | 1/1984 | Marshall et al. | 215/216 |
| 4,479,585 | 10/1984 | Sandhaus | 215/218 |
| 4,662,530 | 5/1987 | Goncalves et al. | 215/330 |
| 4,998,632 | 3/1991 | Morris, Sr. | 215/201 |

*Primary Examiner*—Stephen Marcus
*Assistant Examiner*—Vanessa Caretto
*Attorney, Agent, or Firm*—Jones, Tullar & Cooper

[57] ABSTRACT

A container with a body and a closure which is held captive to the body and which is is disengageable therefrom by urging the closure towards the body to deflect a deformable member on the closure or the body. This opens a pathway along which a retaining member can move, as the closure is rotated relatively to the body.

11 Claims, 3 Drawing Sheets

CONTAINER WITH CHILD PROOF CLOSURE

BACKGROUND OF THE INVENTION

This invention relates generally to a container and is particularly concerned with a container which includes a closure which is resistant to being opened by a young child.

Many dangerous and potentially dangerous commodities such as pharmaceuticals and drugs are dispensed in containers. Despite the best of intentions such containers can, unfortunately, fall into the hands of young children with tragic results. The need thus exists for a container which can be readily opened by an adult but which is capable of resisting the attempts of a young child to open it.

SUMMARY OF THE INVENTION

The invention provides a container which includes a body with a mouth, a closure which is engageable with the body to close the mouth, at least one retaining member which restrains the closure from being disengaged from the body, at least one deformable formation and at least one deflecting member, the closure being movable to a limited extent towards the body whereby the deflecting member deflects the deformable formation to form a pathway along which the retaining member can be moved to permit disengagement of the closure from the body.

Preferably the retaining member is moved along the pathway by rotating the closure relatively to the body.

The container may include detachable sealing means which restrains the closure at least against movement towards the body.

Preferably, when the closure is engaged with the body, the closure is rotatable at least to a limited extent relatively to the body.

The pathway may lie on a spiral about a longitudinal axis of the body.

Similarly the retaining member may have a leading surface, which enters the pathway, which lies on a spiral about a longitudinal axis of the body.

In one embodiment the body includes a neck, the deformable formation is on a surface of the neck, and the deflecting member and the retaining members are on a surface of the closure.

Preferably the neck has a peripheral formation and the retaining member is engageable therewith thereby to restrain the closure from being drawn off the body in an axial direction.

In another embodiment the body has a neck, the deflecting member and the retaining member are on a surface of the neck, and the deformable formation is on the closure.

The closure may comprise a cap and an insert which is engaged with the cap, and the deformable formation is provided on the insert. The insert may have a slot within which the retaining member is locatabe, and the deformable formation is deflected to provide the said pathway from the slot.

In one specific form of the invention there is provided a container which includes a body, a neck on the body, a peripheral formation on the neck, the peripheral formation including a deformable portion, and a closure which is engageable with the neck, the closure including retaining means which engages with the peripheral formation thereby to restrain the closure from being drawn off the neck, the closure being axially movable to a limited extent towards the body and including a member which thereby deflects the deformable portion to form a pathway along which the retaining means can be moved to permit disengagement of the closure from the neck.

In another specific form of the invention the container includes a body, a neck on the body, a deflecting member and a retaining member on the neck, a closure, a slot formation provided on the closure and a deformable member which forms at least part of a wall around the slot, the closure being engageable with the body by moving the closure towards the body and simultaneously rotating the closure relatively to the body whereby the retaining member deflects the deformable member and a pathway is formed along which the rotating member can pass to enter into and engage with the slot, the closure being disengageable from the body by moving the closure towards the body whereby the deflecting member deflects the deformable member to form the said pathway so that with rotational movement of the closure relatively to the body the retaining member can disengage from the slot by passing along the pathway and so permit detachment of the closure from the body.

BRIEF DESCRIPTION OF THE DRAWINGS

The invention is further described by way of examples with reference to the accompanying drawings in which.

DESCRIPTION OF PREFERRED EMBODIMENTS

Figure 1:
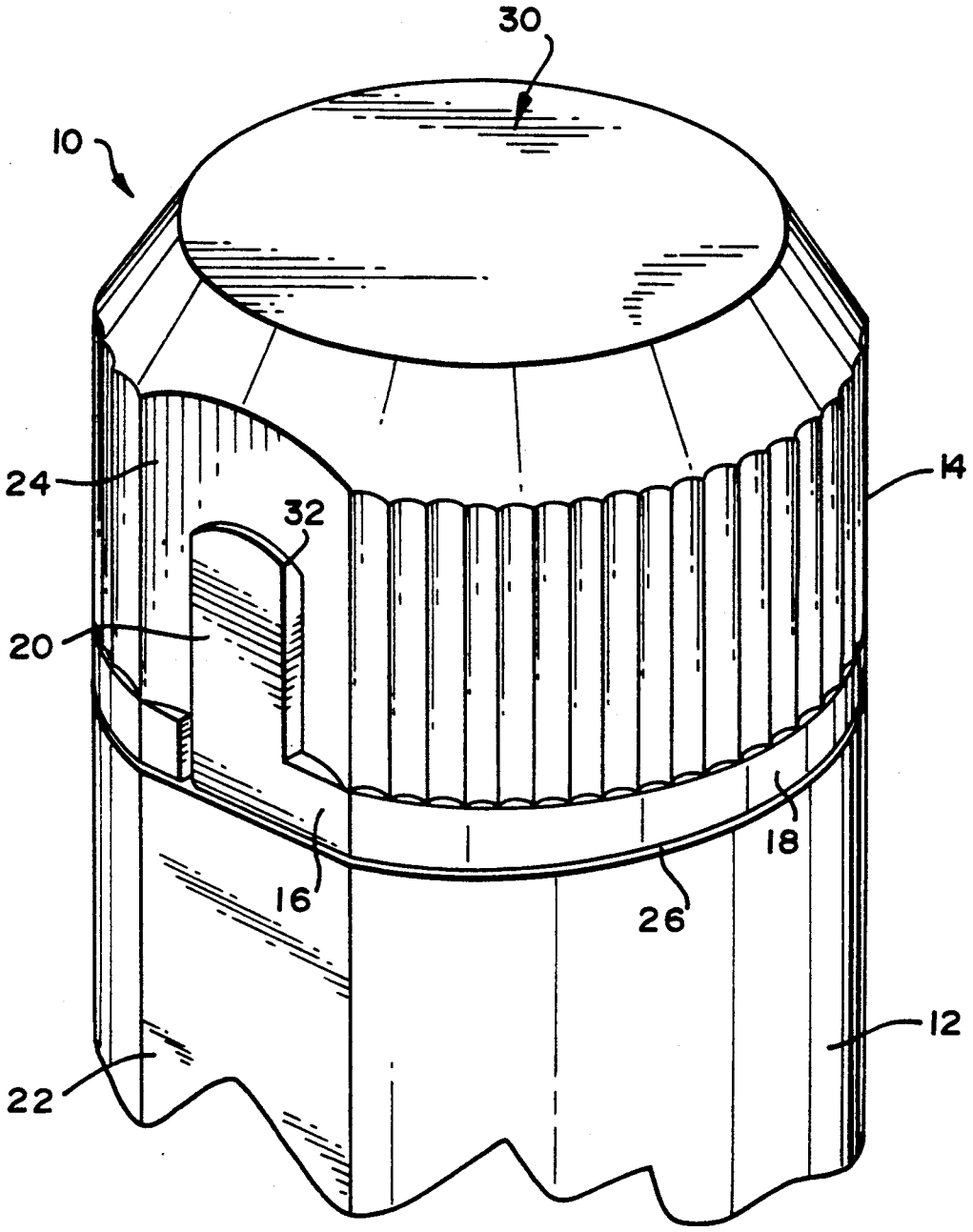
FIG. 1 is a perspective view of portion of a container which includes a closure according to the invention, in a sealed state.
Figure 2:
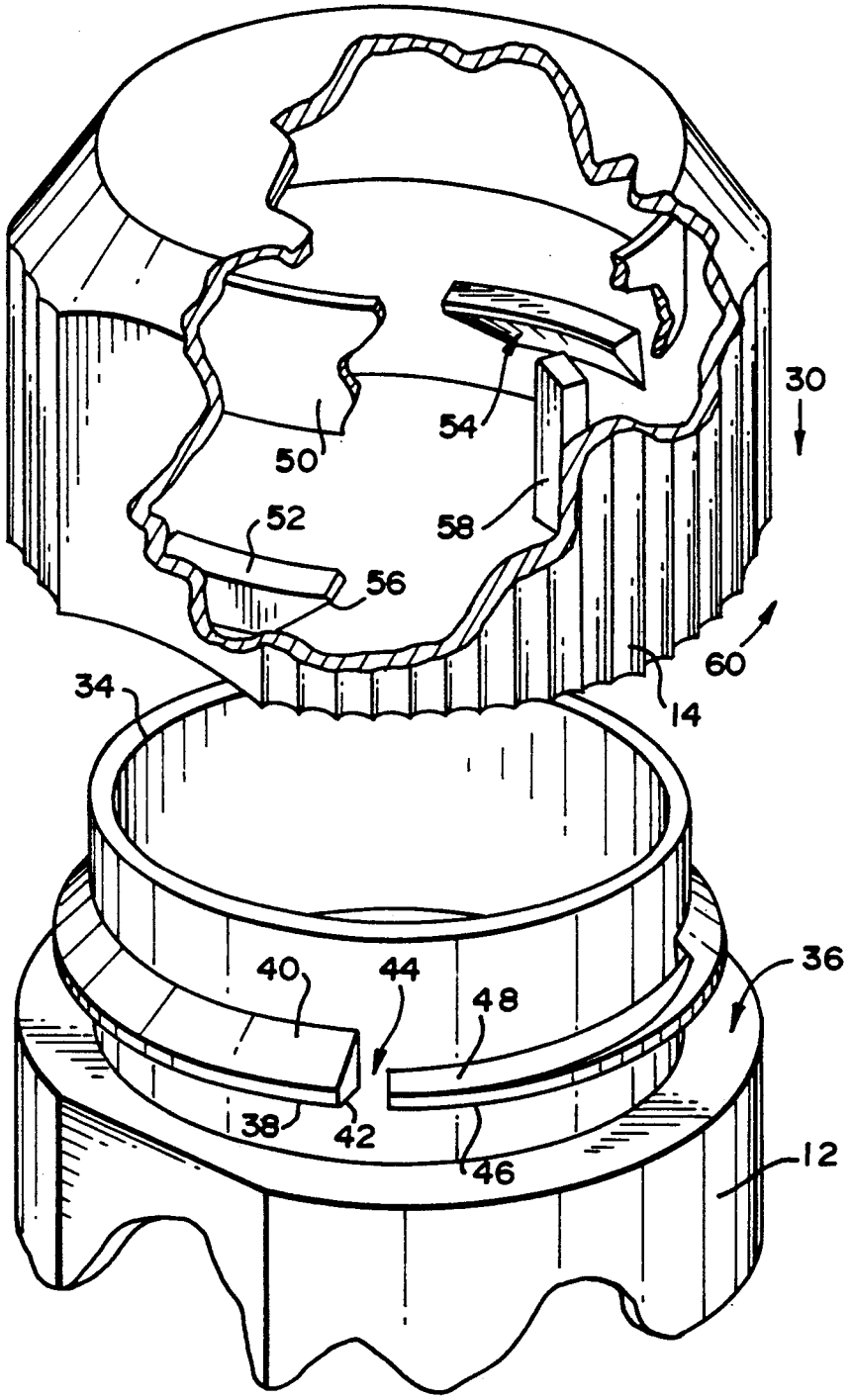
FIG. 2 is a view of the container of FIG. 1 with the closure removed from the container and showing the internal construction of the closure.

FIGS. 1 and 2 of the accompanying drawings illustrate a container 10 according to a first form of the invention which includes a body 12, a closure 14, and a seal 16.

Under sealed conditions, the closure 14 is engaged with the body 12 and kept in engagement by means of the seal 16. The seal includes a strip 18 which lies between opposing edges of the closure 14 and the body 12, and a tab 20 which lies in registering grooves 22 and 24 in the body 12 and in the closure 14 respectively.

The seal is formed integrally with the body 12 and is attached to the body along a tear line 26 which is formed using known techniques.

As will emerge hereinafter the closure 14 is engagable with the body 12 by being forced axially on the body in the direction of an arrow 30. The tab 20 could be tapered at its leading inner surface 32 to facilitate engagement of the closure with the body. When the contents of the container are to be accessed the user pulls on the tab, drawing it outwardly from the grooves and then unwinds the strip 18 from between the closure and the body. The tapered surface 32 facilitates access for removal of the seal.

FIG. 2 shows the internal construction of the body 12 and the closure 14.

The body includes a neck 34 which extends upwardly from a shoulder 36. An outwardly extending peripheral formation 38 is located on the neck. An upper surface 40 of this formation slopes downwardly and outwardly. The underside 42 of the formation, on the other hand, is substantially at right angles to the axis of the body.

A small gap 44 is defined between opposing ends of the peripheral formation 38. To the right of this gap the peripheral formation comprises a deformable portion 46 which is not attached to the neck and which extends from the remainder of the peripheral formation 38. The upper surface 48 of the portion 46 is tapered, increasing in thickness from the gap 44 to the remainder of the peripheral formation 38 to the right in the drawing.

The closure 14 is cup-shaped and includes an inner ring 50 which is shaped to fit inside the neck 34.

The closure, on an inner wall, includes at least one retaining formation 52 which has an underside 54 which slopes in a manner which is complementary to the sloping upper surface 40 of the peripheral portion on the neck of the body 12. The retaining formation 52 has a tapered leading end 56.

A deflecting member 58 is also located on an inner wall of the closure 14.

When the closure 14 is placed on the body 12 the ring 50 fits inside the neck 34 and assists in correctly positioning the closure on the body. The closure is then pushed axially on to the body and the sloping undersurface 54 of the retaining formation or formations 52 then ride on the sloping upper surface 40 of the peripheral formation 38. The components are relatively deformed and the closure is able to move on to the neck until the retaining formations 52 clip into and engage with the flat underside 42 of the peripheral formation 38. The deflecting member 58 rides on an upper surface of the peripheral formation 38 and the closure 14 does therefore not come to rest on the shoulder 36. The two components are effectively locked to one another although the closure 14 can be rotated relatively to the body 12. If any attempt is made to pull the closure 14 from the body this is resisted by the abutting formations 38 and 52.

If the contents of the container are to be dispensed then the grooves 22 and 24 in the body and the closure are brought into register with one another. The closure 14 is forced in the axial direction 30 towards the body and the lower peripheral edge of the closure approaches the shoulder 36. This type of movement is permitted because the deflecting member 58 is, at this stage, engaged with the deformable portion 46 and this portion is deflected by the applied force.

While the axial force is maintained, and the deformable portion 46 held in the deflected position, the closure 14 is rotated in an anti-clockwise direction 60. The gap 44 is opened up when the deformable portion 48 is deflected and, as the closure is rotated, the retaining formation 52 can pass through the enlarged gap with the tapered leading end 56 thereby being brought into engagement with the tapered upper surface 48 of the deformable portion.

Once the retaining formation 52 is riding on the upper surface of the deformable portion 46 the axial force can be released for further rotation of the closure, relatively to the body, brings the closure out of engagement with the peripheral formation 38, with a screw action.

The closure 14 can be re-engaged with the body 12 merely by forcing the closure in an axial direction 30 directly on to the body.

The container of the invention owes its child-proof qualities to the fact that it is necessary to force the closure in an axial direction towards the body and, simultaneously, to rotate the closure relatively to the body. In addition the grooves 22 and 24 must be brought into register. It is believed that a child attempting to open the container will normally try and pull the closure from the body, with or without a twisting action. This type of movement will not detach the components from one another.

The invention is not limited to the precise form of construction shown in the drawings and detailed hereinbefore. The closure can in fact take on any appropriate shape, the essence of the invention lying in the provision of a deformable formation on the body which, once deformed, permits the closure to be detached from the body with a screw action. One modification which is possible is to interchange the components on the closure with the corresponding components on the body so that a deformable portion is located on the closure. This type of construction is also intended to fall within the scope of the present specification. It is also possible to form the seal 16 as part of the closure 14, instead of as an attachment to the body 12.

Figure 3:
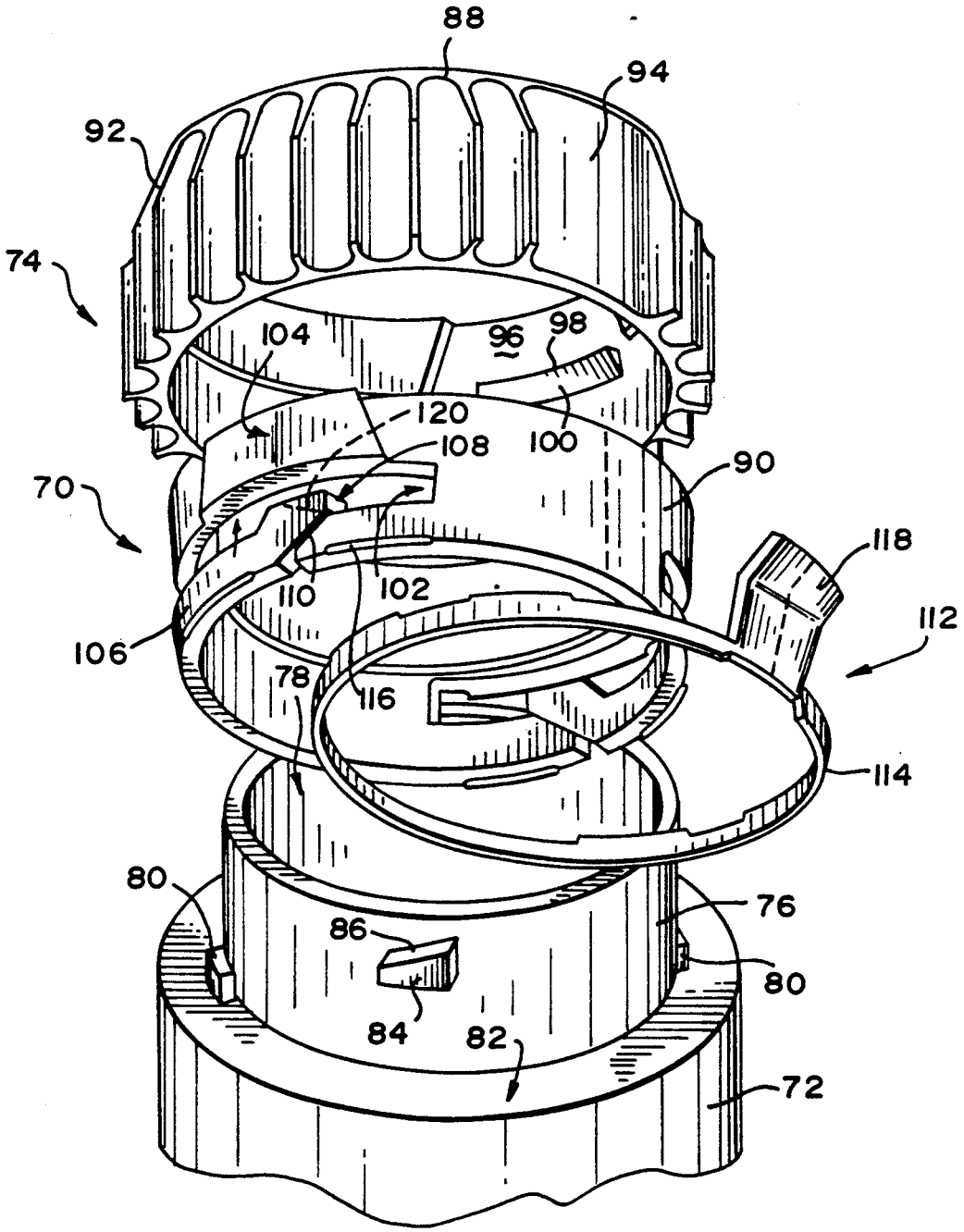
FIG. 3 is a view similar to FIG. 2 of a container according to a different form of the invention.

FIG. 3 illustrates an embodiment of the invention which includes modifications of the type mentioned.

FIG. 3 shows a container 70 which includes a body 72 and a closure 74.

The body 72 is formed with a neck 76 which extends around a mouth 78. Two deflecting members 80 are located on opposing sides of the neck near to a lower shoulder 82 and two retaining formations 84 are positioned on an outer surface of the neck closer to the rim of the neck. Only one of the retaining formations is visible in the drawing. Each retaining formation has a leading upper surface 86 which is inclined and in fact lies on portion of a spiral path which extends around a longitudinal axis of the body.

The closure 74 comprises a cap 88 and an insert 90. The cap has a corrugated outer surface 92 to facilitate manual engagement thereof and a recessed area 94 which is similar to the recess 24 shown in FIG. 1. On its inner surface the cap has two opposed recesses 96, only one of which is visible in the drawing, and below each recess is a catch formation 98 which has a tapered lower surface 100.

The insert 90 comprises an annular ring with opposed slots 102 and opposed protrusions 104 on an outer surface of the insert. Each slot has a deformable member 106 which forms part of the side wall of the slot. The deformable member has a shoulder 108 which extends into the slot. A small gap 110 exists between opposed inclined surfaces of the deformable member 106 and a portion of the insert 90, respectively. The gap at its end which is remote from the slot is flared.

The insert is shown detached from the cap. The insert is in fact designed to be inserted snugly into the cap and when this happens each protrusion 104 is located in one of the complementary recesses 96 so that relative rotation between the insert and the cap is prevented. As the insert is pushed into the cap the tapered surfaces 100 of the catches ride over the protrusions 104 until upper surfaces of the catch formations engage with lower surfaces of the protrusions and partly enter the slots 102.

A detachable seal 112 is provided with the insert 90. The seal includes a ring 114 which is engaged with the insert at a number of locations 116, and a tab 118 which normally lies in the recess 94 of the cap.

When the closure is placed on the neck, and urged towards the body, the retaining formations 84 deflect the deformable members 106 into the space of each respective slot 102 and the gaps 110 are opened up to provide inclined pathways along which the respective retaining formations can move as the closure is rotated relatively to the body. In this way the retaining formations 84 can be advanced into the respective slots 102. When this happens the respective deformable members 106 spring back to the illustrated positions and it is not possible for the closure 74 to be removed from the body. The closure 74 can in fact be moved only to a limited extent by rotating the formations 84 within the slot 102 between positions at which the formations abut side walls of the slots and the shoulders 108 respectively.

If the container is to be opened it is necessary first of all to move the seal 112. This is done by pulling on the tab so that the bonds at the points of attachment 116 are broken.

Once the seal 112 has been removed it is possible for the closure 74 to be urged towards the body 72 so that the lower edge of the closure is more or less in contact with the shoulder 82. When this happens the deflecting members 80 on the neck push the deformable members 106 upwardly, into the slots, and the gaps 110 are opened to form spiral pathways through which the retaining members 84 can be moved, substantially in screw fashion, to permit the closure to be rotated free from the body.

When the closure is to be re-engaged with the body a simple screw action is all that is required for the pointed upper corners of the retaining members easily engage in the flared lower ends of the gaps 110 and with a rotating and pressing action the retaining members can be moved along the pathways which are formed by the open gaps 110.

One modification which can be made to the insert is to taper the shoulders 108, at the slots, so that they are inclined, as is indicated by means of a dotted line 120. If this is done and an attempt is made to rotate the closure, when it is engaged with the body, the retaining members 84 ride up the sloping surfaces 120 and, in fact, secure the closure more tightly to the body.

I claim:

1. A container which includes a body, a neck on the body, a peripheral formation on the neck, the peripheral formation including a deformable portion, and a closure which is engageable with the neck, the closure including retaining means which engages with the peripheral formation thereby to restrain the closure from being drawn off the neck, the closure being axially movable to a limited extent towards the body and including a member which thereby deflects the deformable portion to form a pathway along which the retaining means can be moved to permit disengagement of the closure from the neck.

2. A container according to claim 1 wherein the retaining means is moved along the pathway by rotating the closure relatively to the body.

3. A container according to claim 1 which includes detachable sealing means which restrains the closure at least against movement towards the body.

4. A container according to claim 1 wherein, when the closure is engaged with the body, the closure is rotatable at least to a limited extent relatively to the body.

5. A container according to claim 1 wherein the pathway lies on a spiral about a longitudinal axis of the body.

6. A container according to claim 1 wherein the retaining means has a leading surface which enters the pathway, the pathway lying on a spiral about a longitudinal axis of the body.

7. A container which includes a body, a neck on the body, a deflecting member and a retaining member on the neck, a closure, a slot formation provided on the closure and a deformable member which forms at least part of a wall around the slot, the closure being engageable with the body by moving the closure towards the body and simultaneously rotating the closure relatively to the body whereby the retaining member deflects the deformable member and a pathway is formed along which the retaining member can pass to enter into and engage with the slot, the closure being disengageable from the body by moving the closure towards the body whereby the deflecting member deflects the deformable member to form the said pathway so that with rotational movement of the closure relatively to the body the retaining member can disengage from the slot by passing along the pathway and so permit detachment of the closure from the body.

8. A container according to claim 7 wherein the closure comprises a cap and an insert which is engaged with the cap, and wherein the deformable member is provided on the insert.

9. A container according to claim 8 wherein the insert has a slot within which the retaining member is locatable, and the deformable member is deflected to provide the said pathway from the slot.

10. A container according to claim 7 which includes detachable sealing means which restrains the closure at least against movement towards the body.

11. A container according to claim 7 wherein when the closure is engaged with the body, the closure is rotatable at least to a limited extent relatively to the body.

* * * * *